United States Patent [19]

Egelhof

[11] Patent Number: 4,836,895

[45] Date of Patent: Jun. 6, 1989

[54] HEADBOX FOR PAPER MACHINES OR THE LIKE

[75] Inventor: Dieter Egelhof, Heidenheim, Fed. Rep. of Germany

[73] Assignee: J. M. Voith GmbH, Heidenheim, Fed. Rep. of Germany

[21] Appl. No.: 124,901

[22] Filed: Nov. 24, 1987

[30] Foreign Application Priority Data

Nov. 27, 1986 [DE] Fed. Rep. of Germany ..... 3640632

[51] Int. Cl.[4] ..... D21F 1/06

[52] U.S. Cl. ..... 162/259; 162/344; 162/347; 162/375

[58] Field of Search ..... 162/259, 344, 346, 347, 162/375

[56] References Cited

U.S. PATENT DOCUMENTS 4,406,740 9/1983 Brieu ..... 162/347

4,640,742 2/1987 Helleur ..... 162/347

*Primary Examiner*—Peter Chin

*Attorney, Agent, or Firm*—Albert L. Jeffers; Richard L. Robinson

[57] ABSTRACT

A headbox for dispensing a machine-width suspension flow from a machine-width nozzle type discharge channel which is defined by two machine-width flow control walls converging on each other. Located on the downstream end is a machine-width discharge gap for the flow of suspension. One of the two flow control walls is for fine adjustment of the discharge gap width and is equipped with an elastically flexible wall section which extends across the machine width. This wall section is equipped with a number of areal heating elements in a succession across the machine width, with which material layers having different coefficients of heat expansion may be coordinated. By appropriate heating of individual heating elements it is possible to achieve a local deformation of the flexible wall section and thus a local change of the discharge gap width and a correction of the basis weight cross profile of the paper web produced.

17 Claims, 2 Drawing Sheets

HEADBOX FOR PAPER MACHINES OR THE LIKE

The invention generally concerns a headbox for paper machines or the like and more particularly a headbox for dispensation of a machine-width flow of suspension from a machine-width nozzle type discharge channel which is defined by two machine-width flow control walls that converge on each other and on the downstream end of which there is located a machine-width discharge gap for the flow of suspension.

A previous headbox is known from U.S. Pat. No. 4,406,740 (FIG. 1). There, a number of adjustment pipes, arranged successively and spaced across the machine, each engage by way of a joint the downstream rim of the flexible wall section, in the cavity of which pipes an electric heating element is arranged. The adjustment pipes are relatively long and extend approximately perpendicularly to the plane of the flexible wall section. On the end away from the wall section each of the adjustment pipes bears on the upper end of a second support pipe which is somewhat larger in diameter and envelopes the adjustment pipe coaxially. The support pipe extends from the upper end toward the flexible wall section and terminates at a distance from the flexible wall section on a box-shaped carrier, which bears the support pipe and which also supports the flow control wall with the flexible wall section. By heating one of the many long adjustment pipes it is possible to achieve an elongation of such pipe and thus a localized bending of the flexible wall section, and hence a local correction of the discharge gap width. Disadvantages of this prior design are that the pipes require a relatively large amount of space and that the accuracy of the effect of the adjustment device depends on the form stability of the carrier which bears the support pipes. A similar design, previously known as well, has been described in European patent publication 00 75 782.

A serious problem with such headboxes is constituted by the necessity of keeping the discharge gap width constant across the machine width. Variations from the desired gap width affect the quality of the paper web created, specifically, the cross machine basis weight profile becomes non-uniform. Therefore, attempts have been made at solving this problem by an extremely precise fabrication of components assembled with high accuracy to a dimensionally stable headbox. The objective was to require a localized adjustment of the flexible wall section by only relatively small amounts, so as to render the basis weight cross profile more uniform. But this is aggravated by the fact that tolerances, for instance between the components of bearings and joints, have an adverse effect on the accuracy of adjustment of the gap width of the headbox.

A headbox adjusted to a constant gap width is subject to variations during the operation of the paper machine, which are caused primarily by temperature changes. These occur, e.g., when the machine is started again with heated pulp after a standstill. In this case, the flow control walls of the headbox assume the higher temperature of the pulp suspension only gradually. Especially unpleasant are gap width changes which occur across the machine in varying degree at various spots of the headbox. For instance, the influx of cold air into the machine hall (for instance through opening a door) may lead to a one-sided change of the gap width. Therefore, attempts have so far been made to compensate for these changes by a localized adjustment of the initially mentioned flexible wall section, in order to achieve the basis weight cross profile sought after. But this is frequently not managed to the desired degree.

A problem underlying the invention is to provide a headbox of the initially described category whose device for adjustment of the basis weight cross profile (by means of zoned adjustment of the discharge gap width) works more accurately than in prior designs and is more insensitive to disturbances, for example to changes of the ambient temperature.

This problem is solved through the features of the present invention. The solution is favorable insofar as the heat buildup in the heating elements generates bending forces which act directly on the flexible wall section, leading to its deformation and thus to a change of the discharge gap width. Due to the coplanar arrangement of the areal heating elements on the downstream and flexible section of the flow control wall, the bending forces are generated within the flexible wall section itself. It is thus no longer necessary to have the downstream rim of the flexible wall section bear indirectly on a carrier, as in the U.S. Pat. No. 4,406,740. Changes of the discharge gap width previously resulting from the lack of form stability of the carrier have thus been eliminated. Additionally, the heating elements take up little space, so that the flexible wall section can be equipped with them in a close succession. As a result, localized changes of the gap width are limited to a narrow area as regards the machine width. This enables a locally very accurate correction of a faulty basis weight cross profile. In addition, the headbox according to the present invention can be given a very slender cross-sectional configuration, i.e., the space requirement for the pipes needed according to the U.S. Pat. No. 4,406,740 is eliminated.

FIG. 7 of the European patent publication 00 75 782 illustrates an arrangement where coplanar areal heating elements 10 are arranged on an upper flow control wall 3D. But these heating elements are situated on the upstream end of the flow control wall 3D and serve to vary the length of this wall, shifting the downstream end 9 of this wall horizontally. An expansion element 2 which (similar to U.S. Pat. No. 4,406,740) bears on a carrier 7 serves to change the width of the discharge gap.

Further favorable developments of the invention and embodiments will be more fully explained hereafter with the aid of the drawing.

Figure 1:
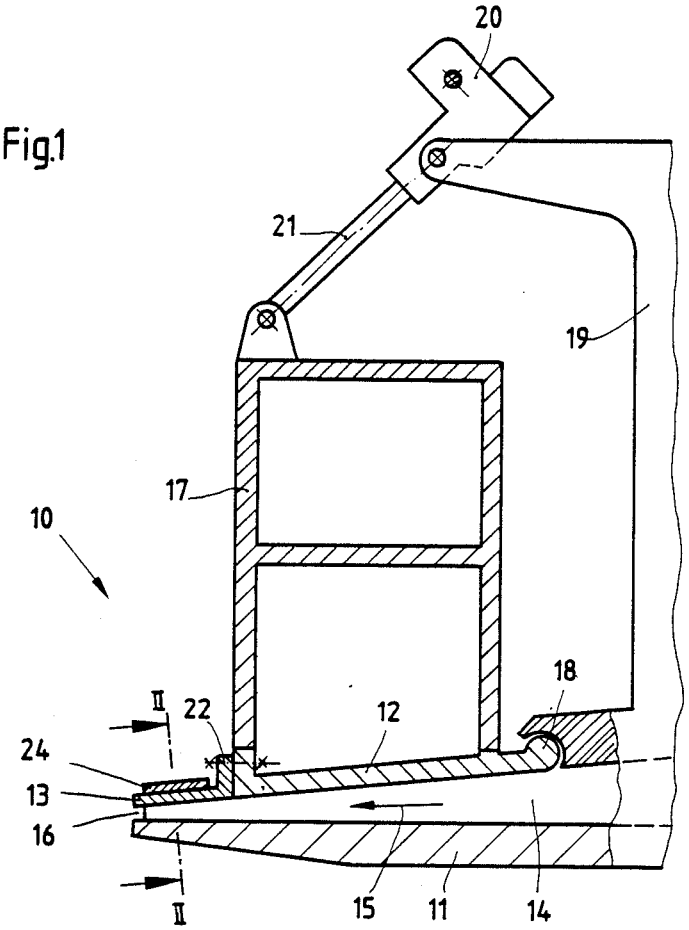
FIG. 1 shows a headbox, preponderantly as a section parallel with the longitudinal direction of the paper machine, with a discharge channel defined by an upper and lower flow control wall, the upper wall featuring a flexible wall section which is provided with electric heating elements.

The headbox 10 illustrated in FIG. 1 has a rigid, lower flow control wall 11 which extends horizontally. Extending above the wall 11 is a second flow control wall 12 with a wall section 13 joined to the end of it. Extending the width of the machine and converging relative to each other, the flow control walls 11 and 12 with the wall section 13 define a machine-width nozzle type discharge channel 14 for stock suspension. Located at the downstream end (arrow 15 indicates the direction of flow of the paper stock suspension) of the discharge channel 14 is a machine-width discharge gap 16 for issuing the flow of stock.

Reinforced by a box-shaped carrier 17, the upper flow control wall 12 is mounted, together with the downstream wall section 13, by means of a joint 18 on the housing 19 of the headbox 10. By pivoting the upper flow control wall 12 clockwise about the axis of the joint 18, the width of the discharge gap 16 can be enlarged; by pivoting counterclockwise it can be reduced. This coarse adjustment of the discharge gap width is effected with the aid of drives 20, each of which by means of a spindle 21 attaches on both ends to the carrier 17 of the upper flow control wall.

Figure 2:
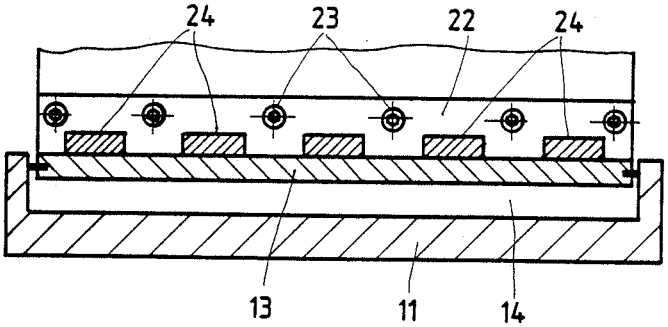
FIG. 2 shows a sectional view along line II—II in FIG. 1, of the wall section and the lower flow control wall.

For fine adjustment of the discharge gap width, the downstream wall section 13 extending across the machine width is of an elastic design. Along its mounting flange 22, this wall section is firmly connected with the upper flow control wall 12 by means of screws 23 and equipped with a number of heating elements 24 (FIG. 2) which are successively arranged across the machine width. The heating elements are areal and situated in at least approximately coplanar manner on the flexible wall section 13. The length of each, measured in parallel with the direction of flow 15 (FIG. 1), is preferably greater than the width measured in FIG. 2. By controlled heating of the individual heating elements 24 it is possible to generate bending forces which act directly on the flexible wall section 13, leading to a localized deformation of the wall section and thus to a localized change of the discharge gap width. The heating elements 24 are arranged on the wall section 13 in the direction of the machine width at a spacing such that, if needed, the discharge gap width can be influenced continuously across the machine width.

Figure 3:
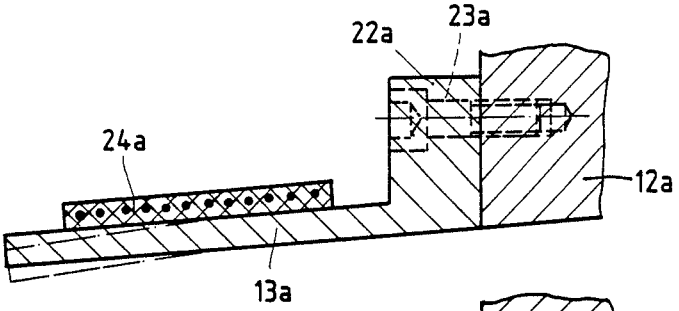
FIGS. 3 through 6 show sectional views of four embodiments of wall sections which are variously equipped with heating elements.

In the first embodiment illustrated in FIG. 3, the area originating downstream from the mounting flange 22*a*, of the flexible wall section 13*a*, is cross-sectionally of a thin-walled design. Having an areal design as well, a heating element 24*a* is placed directly on and connected with the side of the wall section 13*a* away from the suspension flow. As heat flows from the heating element 24*a* into the flexible wall section 13*a*, its top side (away from the suspension flow) is heated more heavily than its underside (near the suspension flow). This leads to a curvature of the flexible wall section 13*a* that reduces the discharge gap width, this curvature being indicated in the figure by dash-dot lines. This embodiment is distinguished by a very low expense.

Figure 4:
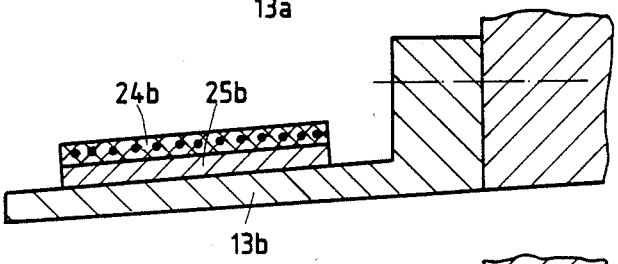

In the second embodiment according to FIG. 4, the downstream flexible wall section 13*b* has the same slender cross-section as in the previous example. Disposed between each of the areal heating elements 24*b* and the wall section 13*b* is an intermediate layer in the form of a plate 25-*b*, which is made of a material with a coefficient of heat expansion that is greater than that of the material of the wall section 13*b*. The plate 25*b* is connected with the wall section 13*b* in a nonpositive or positive (form-fitting) or material-fitting manner. This achieves upon heat buildup in the heating element 24*b* a bimetal effect where the volume gain of the plate 25*b* is greater than that of the wall section 13*b*. As compared with FIG. 3, the wall section 13*b* (at same heat infusion) undergoes a deformation greater than without the use of the bimetal effect. In variation from FIG. 4, the length of the plate 25*b* may be made greater than the length of the heating element 24*b*.

Figure 5:
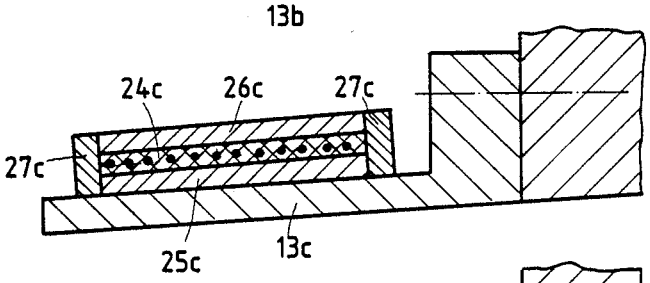

The third embodiment illustrated in FIG. 5 features a wall section 13*c* with a slender cross-section as well. Having an areal design, the heating element 24*c* is surrounded on both sides by material layers in the form of two plates 25*c* and 26*c* which possess different coefficients of heat expansion. The lower plate 25*c* with the lower coefficient of heat expansion connects on the side away from the flow in nonpositive or positive (form-fitting) or material-fitting fashion with the wall section 13*c*. The upper plate 26*c* has the greater coefficient of heat expansion. On their ends (relative to the direction of flow of the suspension), the two plates 25*c* and 26*c* are firmly connected with the wall section 13*c* by way of fixed link type abutments 27*c*. A heat buildup in the heating element 24*c* which is lower than in the preceding embodiments leads to a pronounced downward curvature of the wall section 13*c* corresponding to that of FIG. 3. Conceivable also is a trading of the two plates 25*c* and 26*c* so that the upper plate will exhibit the smaller coefficient of heat expansion and the lower plate the greater one. In this case, the heat supply will cause an upward curvature of the flexible wall section.

Figure 6:
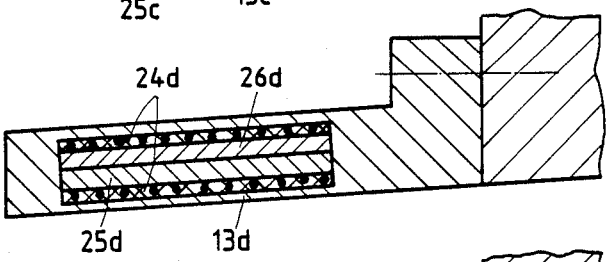

In the fourth embodiment according to FIG. 6, the wall section 13*d* has a relatively thick cross-section transverse to the flow direction of the suspension. Embedded in wall section 13*d* are two material layers in the form of plates 25*d* and 26*d* which border directly on each other. The lower plate 25*d* has a smaller coefficient of heat expansion than the upper plate 26*d*. Both plates are enveloped by a heating element 24*d*. A heat buildup in the heating element 24*d* results in a greater volume expansion of the upper plate 26*d* in contrast to the lower plate 25*d*. The resulting deformation of the two plates 25*d* and 26*d* connected with each other causes a curvature of the flexible wall section 13*d* in the desired sense. This embodiment is especially suited for wall sections 13*d* which consist of plastic and, thus, are poor heat conductors.

As indicated above, the effect of an individual heating element is restricted to a relatively narrow zone of the discharge gap, i.e., adjacent zones will not be influenced or only little. This increases the accuracy of any correction of the cross profile of the paper web being made. To achieve in this respect even better results, a secondary heating element which is effective in the other direction can be arranged between each two adjacent primary heating elements (e.g., 24*a*). For instance, when the primary heating elements 24*a* according to FIG. 3 cause a downward deformation of the flexible wall section 13*a*, secondary heating elements provided in between can, when needed, trigger an upward deformation of the wall section 13*a*, as has been explained above.

Figure 7:
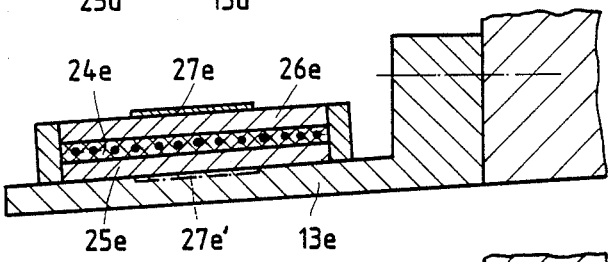
FIG. 7 shows an embodiment according to FIG. 5, with a wire strain gauge coordinated with the heating element.

The fifth embodiment according to FIG. 7 has the same structure as that according to FIG. 5, but a wire strain gauge 27*e* is provided on the top side, away from the suspension flow, of the upper plate 26*e*. This strain gauge 27*e* makes it possible to determine the deformation of the plate 26*e* and to draw conclusions on the change of the discharge gap width as heat builds up in the heating element 24*e*. Such a wire strain gauge may also bear directly on the wall section 13*e* (as indicated by dash-dot lines and reference numeral 27*e'*) for direct determination of its deformation.

Figure 8:
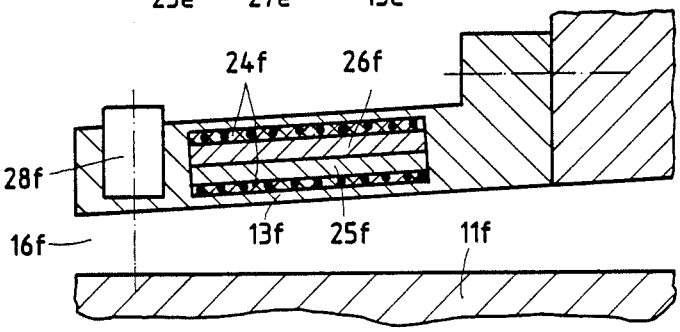
FIG. 8 shows an embodiment according to FIG. 6 with a device measuring the width of the gap between the wall section and the lower flow control wall.

The sixth embodiment illustrated in FIG. 8 corresponds extensively with that relative to FIG. 6. Additionally, a measuring device 28*f* for measuring the width of the discharge gap 16*f*, coordinated with the heating element 24*f*, is arranged on the free end of the wall section 13*f*. The measuring device 28*f* includes a noncontact pickup for determining the distance between the flexible wall section 13*f* and the opposite lower flow control wall 11*f* at the measuring location. This determines the gap width in the immediate vicinity of the discharge gap 16*f*.

The flexible wall section 13 (or 13*a*–13*f* respectively) forms in the illustrated embodiments a coplanar extension of the upper flow control wall 12; i.e., both wall sections 12 and 13 converge at the same angle to the lower flow control wall 11. But in variation thereof an arrangement may as well be chosen where the angle of convergence on the flexible, downstream wall section 13 is greater than on the upstream wall section 12.

Each of the heating elements 24 arranged across the machine width may form an actuator in a control system which favorably is incorporated in a process control system of the paper machine. In this control system, for instance, the basis weight cross profile is continuously measured at the end of the production process. Variances of the actual basis weight cross profile from the standard profile are determined by the process control system and compensated for by control of the heating elements 24 with the aid of the heating current, the temperature of the heating elements or the elastic deformation of the flexible wall section 13. This is based on a uniform deformation of the wall section 13 achieved by heat buildup in all heating elements 24 which leads to the desired basis weight cross profile. If on the finished paper web an erroneous increase of the basis weight is determined in an adjacent area, the heating element 24 coordinated with that area can be stimulated to a greater heat buildup, thus reducing the pertaining zone of the discharge gap 16 so as to reduce the basis weight there to the desired value by reduction of the suspension jet thickness. In contrast, a localized erroneous reduction of the basis weight is compensated for by a diminished heat stimulation of the respective heating element 24 and, thus, an increase of the discharge gap width. All that is necessary to enable an especially deliberate performance of such a correction of erroneous variances of the basis weight profile is arranging the heating elements 24 at a maximally close spacing in the direction of the machine width.

What is claimed is:

1. A headbox for paper machines for dispensing a machine-width flow of suspension, said headbox comprising:

a pair of converging flow-control walls defining therebetween a nozzle-type discharge channel, at least one of said pair of flow-control walls having at a downstream end thereof a machine-width flexible wall section having a free end which together with the other of said pair of flow-control walls defines therebetween a machine-width discharge gap for the flow of suspension; and means for bending by differential thermal expansion a selected zone of the flexible wall section for local fine adjustment of the discharge gap, said means including a plurality of planar heating elements arranged in a row across the machine width at least approximately coplanar with the flexible wall section and connected in thermal communication therewith.

2. A headbox according to claim 1, in which the heating elements are set directly on the side of the flexible wall section away from the suspension flow.

3. A headbox according to claim 1, and further including between each heating element and the flexible wall section a planar plate fixed to the heating element and to the flexible wall section parallel therewith, each plate having a coefficient of heat expansion greater than that of the flexible wall section.

4. A headbox according to claim 1, and further including a first planar plate fixed to one side of the heating element parallel therewith and a second planar plate fixed to another side of the heating element parallel therewith, the first planar plate being fixed to the side of the flexible wall section away from the suspension flow, the first and second planar plates having different coefficients of heat expansion.

5. A headbox according to claim 1, and further including a first planar plate fixed to one side of the heating element parallel therewith and a second planar plate fixed to another side of the heating element parallel therewith, the first planar plate being fixed to the side of the flexible wall section away from the suspension flow, the first and second planar plates having different coefficients of heat expansion, the first plate having a coefficient of heat expansion greater than that of the flexible wall section.

6. A headbox according to claim 1, in which two planar plates border directly on each other and have different coefficients of heat expansion and are enveloped by the heating element and embedded in the flexible wall section.

7. A headbox according to claim 1, in which each heating element has associated therewith a wire strain gauge which bears on the flexible wall section proximate the heating element.

8. A headbox according to claim 2, in which each heating element has associated therewith a wire strain gauge which bears on the flexible wall section proximate the heating element.

9. A headbox according to claim 3, in which each heating element has associated therewith a wire strain gauge which bears on the flexible wall section proximate the heating element.

10. A headbox according to claim 4, in which each heating element has associated therewith a wire strain gauge which bears on the flexible wall section proximate the heating element.

11. A headbox according to claim 4, in which each heating element has associated therewith a wire strain gauge which bears on a planar plate proximate the heating element.

12. A headbox according to claim 1, in which together with each heating element a means for measuring the width of the discharge gap is arranged on the free end of the flexible wall section.

13. A headbox according to claim 2, in which together with each heating element a means for measuring the width of the discharge gap is arranged on the free end of the flexible wall section.

14. A headbox according to claim 1, and further including control system means for controlling each of said heating elements, said control system means having profile means for determining variance of actual basis weight cross profile of the flow of suspension from a standard profile, said control system having actuator means for generating and feeding a correcting variable to each of the heating elements, which correcting variable fed to the heating element corresponds to the variance of the actual basis weight cross profile from the standard profile.

15. A headbox according to claim 7, and further including control system means for controlling each of said heating elements, said control system means having profile means for determining variance of actual basis weight cross profile of the flow of suspension from a standard profile, said control system having actuator means for generating and feeding a correcting variable to each of the heating elements, which correcting variable fed to the heating element corresponds to the variance of the actual basis weight cross profile from the standard profile.

16. A headbox according to claim 11, and further including control system means for controlling each of said heating elements, said control system means having profile means for determining variance of actual basis weight cross profile of the flow of suspension from a standard profile, said control system having actuator means for generating and feeding a correcting variable to each of the heating elements, which correcting variable fed to the heating element corresponds to the variance of the actual basis weight cross profile from the standard profile.

17. A headbox according to claim 12, and further including control system means for controlling each of said heating elements, said control system means having profile means for determining variance of actual basis weight cross profile of the flow of suspension from a standard profile, said control system having actuator means for generating and feeding a correcting variable to each of the heating elements, which correcting variable fed to the heating element corresponds to the variance of the actual basis weight cross profile from the standard profile.

* * * * *